US006343856B1

(12) United States Patent
Stolk et al.

(10) Patent No.: US 6,343,856 B1
(45) Date of Patent: Feb. 5, 2002

(54) INK JET ARRAY

(75) Inventors: Hendrik Jan Stolk, Bergen; Peter Joseph Hollands, Baarlo, both of (NL)

(73) Assignee: OCE-Technologies B. V., MA Venlo (NL)

( * ) Notice: Subject to any disclaimer, the term of this patent is extended or adjusted under 35 U.S.C. 154(b) by 0 days.

(21) Appl. No.: 09/481,397

(22) Filed: Jan. 12, 2000

(30) Foreign Application Priority Data

Jan. 25, 1999 (NL) ..... 1011126

(51) Int. Cl.[7] ..... B41J 2/045; B41J 2/015
(52) U.S. Cl. ..... 347/68; 347/20
(58) Field of Search ..... 347/20, 68, 71, 347/72, 89, 85, 75

(56) References Cited

U.S. PATENT DOCUMENTS 4,314,259 A * 2/1982 Cairns et al. ..... 347/75
4,364,067 A 12/1982 Koto et al.
5,618,120 A * 4/1997 Ishikawa ..... 400/708

FOREIGN PATENT DOCUMENTS

JP 358167171 * 10/1983 ..... B41J/3/04
JP 04099634 A * 3/1992 ..... B41J/2/045

OTHER PUBLICATIONS

English abstract: JP 55–067476, May 21, 1980, Komai Hiromichi.

* cited by examiner

*Primary Examiner*—John Barlow
*Assistant Examiner*—Alfred Dudding

(57) ABSTRACT

A device for delivering ink to a sheet of paper which includes a body member containing side surface portions which extend into a head surface, the head surface being inclined at an angle relative to the side surface portions forming a head end portion, an ink distribution chamber provided in the body member, a plurality of ink delivery nozzles disposed at the head end portion and a plurality of ink passages extending along one or more of the side portions between the ink distribution chamber and the ink delivery nozzles, and an ink propulsion overall located at said ink passages for selectively propelling ink through the ink passages to the ink delivery nozzles, wherein the ink passages are formed as substantially parallel continuous open ducts in the side surfaces and the adjoining head surfaces of the body member.

13 Claims, 4 Drawing Sheets

INK JET ARRAY

BACKGROUND OF THE INVENTION

The present invention relates to a device for delivering ink, more particularly to a print head for an ink jet printer, provided with a series of ink delivery nozzles which can be actuated selectively for printing a sheet of paper or the like. The present invention also relates to an ink jet printer provided with such a print head.

A device of this kind is known, inter alia, from U.S. Pat. No. 4,364,067. In one embodiment, the print head comprises a base member or plate, which is substantially triangular in cross-section, and which is disposed with the apex extending towards the paper for printing and has at its top, two ink inlets situated at the top ends of the oblique sides and connected to an ink reservoir. Each of the ink inlets leads into an ink distribution chamber, to which are connected a plurality of ducts formed in the associated oblique side. In the plane of the associated oblique side these ducts converge with an arc towards a number of obliquely extending ink delivery nozzles. The ducts are each provided with a constriction and a pressure chamber situated directly downstream thereof. The ducts are covered by a vibrating plate on which an electrode is disposed. At the pressure chambers piezo-electric elements provided with an electrode are mounted on the first-mentioned electrode. By selective actuation of the piezo-electric elements the vibrating plate is pressed in locally and the volume of the pressure chamber in the required duct is reduced so that a specific quantity of ink is propelled through said duct to the associated ink delivery nozzle.

A disadvantage of the known printer head is that making the ducts in the base member causes considerable trouble and effort.

A comparable difficulty is found in making ink passages in another known printer head, which is provided with a base member or base plate with two flat sides and a head surface, each side being formed with a row of parallel ink ducts which near the corner to the head surface merge into ink tunnels extending through the base member towards the head surface.

SUMMARY OF THE INVENTION

According to the present invention, there is provided a device for delivering ink to a sheet of paper or the like, comprising a body with sides and a head surface disposed at an angle to the sides and having therein an inlet for the ink originating from a reservoir. A distribution chamber is provided with a number of ink delivery nozzles situated at the head surface and a plurality of ink passages extend between the distribution chamber and the ink delivery nozzles along one or more of the sides of the body. Means located at the ink passages are provided on that side for selectively propelling ink therethrough to the ink delivery nozzles, wherein the ink passages, over the path from at least the pass-through means to the ink delivery nozzles, are formed as parallel continuous open ducts in the surface of the associated side and the adjoining head surface of the body.

As a result of the parallel configuration and continuous attitude at the surface of the body, the production of the ducts in the associated side and the head surface can take place accurately in a continuous operation by machining in the direction of the ducts. For the machining it is possible for example to use a milling tool with a number of parallel milling discs.

Preferably, the ducts follow a smoothly convexly curved path in the associated side and the adjoining head surface, particularly in the transition zone thereof. As a result, the ink flow is smoother and ink delivery can take place more accurately.

The machining operation can in this way progress more smoothly and any gaps in machining which might result in inaccuracies can be kept to a minimum.

Machining is further simplified if the surfaces of the associated side and the adjoining head surface are smoothly convexly curved at least in the transition zone thereof. In this case, closing the ducts off from the exterior is facilitated since they can be covered by a continuous ink-tight layer, such as a suitable foil, without the foil having to be plastically deformed locally, as would be the situation in the case of a sharp transition.

This layer can easily be given a further function, by having the ink delivery nozzles, which are situated at the downstream ends of the ducts, formed in said ink-tight layer. The number of machining operations on the body can then be kept to a minimum. Parallel with this machining, the ink-tight layer can be prepared and then be applied to the body in one operation.

Further simplification is obtained if the ink propulsion means comprises a plurality of piezo-electric elements operative on the ducts with the ink-tight layer extending between the piezo-electric elements and the ducts.

Since the body does not need any material to form the outward boundary of the ink passages, the latter can be disposed with a smaller center-to-center distance from one another.

In another development of the device according to the present invention, this advantage is enhanced in that the body is provided with two opposite sides in which the ducts are formed, and the ducts in one side are offset from the ducts in the opposite side, the ducts having a conical downstream end. This conical end is produced as if automatically by a milling tool with which the substantially T, V or U-shaped ducts are made, when the tool comes to the end of the ducts. The conical ends of the alternate ducts ensure that the ducts at the delivery end, and hence the ink delivery nozzles, can be situated closer together than would otherwise be the case even if the ink delivery nozzles are situated in line with one another. The result is a denser and hence tighter print pattern on the sheet of paper.

BRIEF DESCRIPTION OF THE DRAWINGS

The PRESENT invention will now be explained with reference to a number of exemplified embodiments illustrated in the accompanying drawings wherein.

DETAILED DESCRIPTION OF THE INVENTION

The print head attachment 1 comprises a plate 2, which can, for example, be made of a ceramic material, and which is also known as a base plate. The base plate 2 has a plane of symmetry S and is provided with means for attaching an ink jet printer (not shown in detail), e.g. by utilizing screw holes 22.

Figure 3:
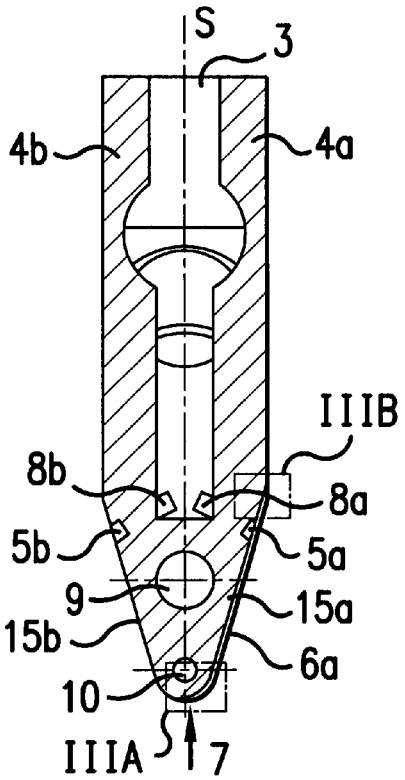
FIG. 3 is a cross-section through the print head attachment shown in FIG. 1, taken along line III—III.
Figure 3B:
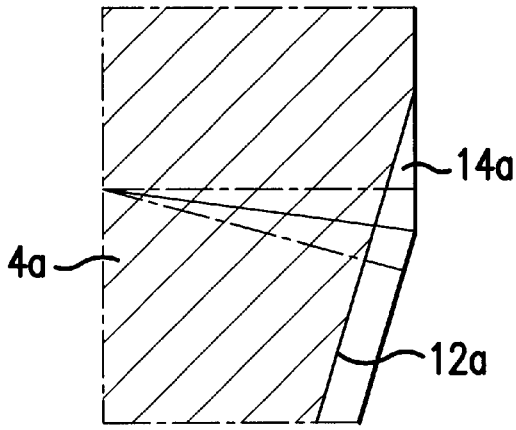
FIGS. 3A and 3B are details of the cross-section in FIG. 3.

As will be clearer from FIG. 3, the base plate 2 is provided with a number of cavities 3, 9 and 10. Cavity 3 is connected in the ink jet printer to an ink source and may be divided if required. The hollow space 3 is bounded on the long sides by walls 4*a* and 4*b* which extend in parallel relationship but which meet at the bottom in a conical bottom portion of the base plate, where oblique sides 15*a*, 15*b* and a convexly curved head surface 7 are formed.

At the bottom end, the hollow space 3 is provided with passages 8*a* and 8*b* which extend to the sides 15*a*, 15*b* and lead into elongate ink distribution chambers 5*a*, 5*b*.

Figure 3A:
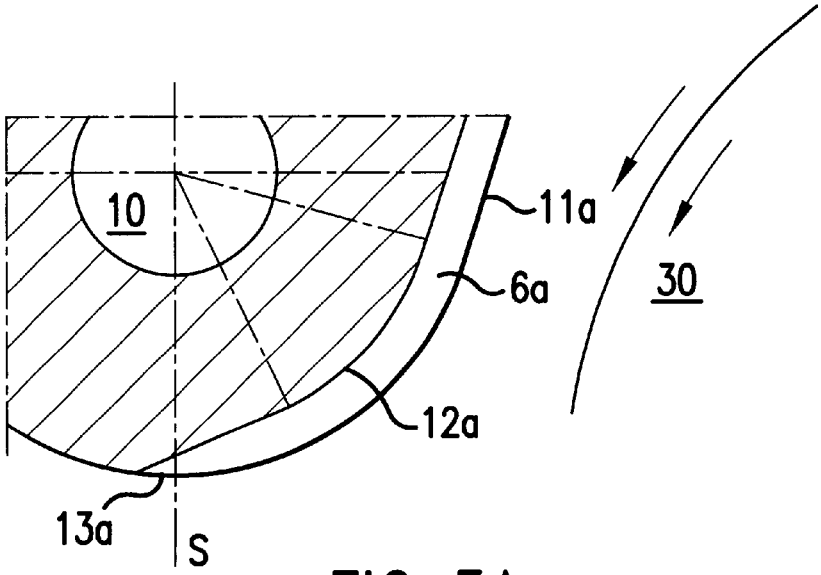

Rows of parallel grooves forming ink ducts 6*a* and 6*b*, respectively, are cut in the surfaces of the sides 15*a*, 15*b* and in the surface of the head 7, although only a number of these ducts is shown. These ducts extend through from the zone of the distribution chambers 5*a*, 5*b* to the middle zone of the head surface 7. To make the ducts, a milling tool 30 as shown diagrammatically in FIG. 3A, consisting for example of a series of parallel milling discs, can be easily moved along the sides 15*a* and the head surface 7. Under these conditions the top end of the duct 6*a*, after initially extending parallel with the side surface 15*a* by the base 12*a*, extends with the end portion 14*a* obliquely in the vertical (with respect to the drawing) surface of the wall 4*a*. In the head surface 7 the bottom 12*a* of the duct 6*a* extends with the end part 13*a* obliquely and straight to end in the surface of the head surface 7 somewhat past the plane of symmetry S.

Figure 1:
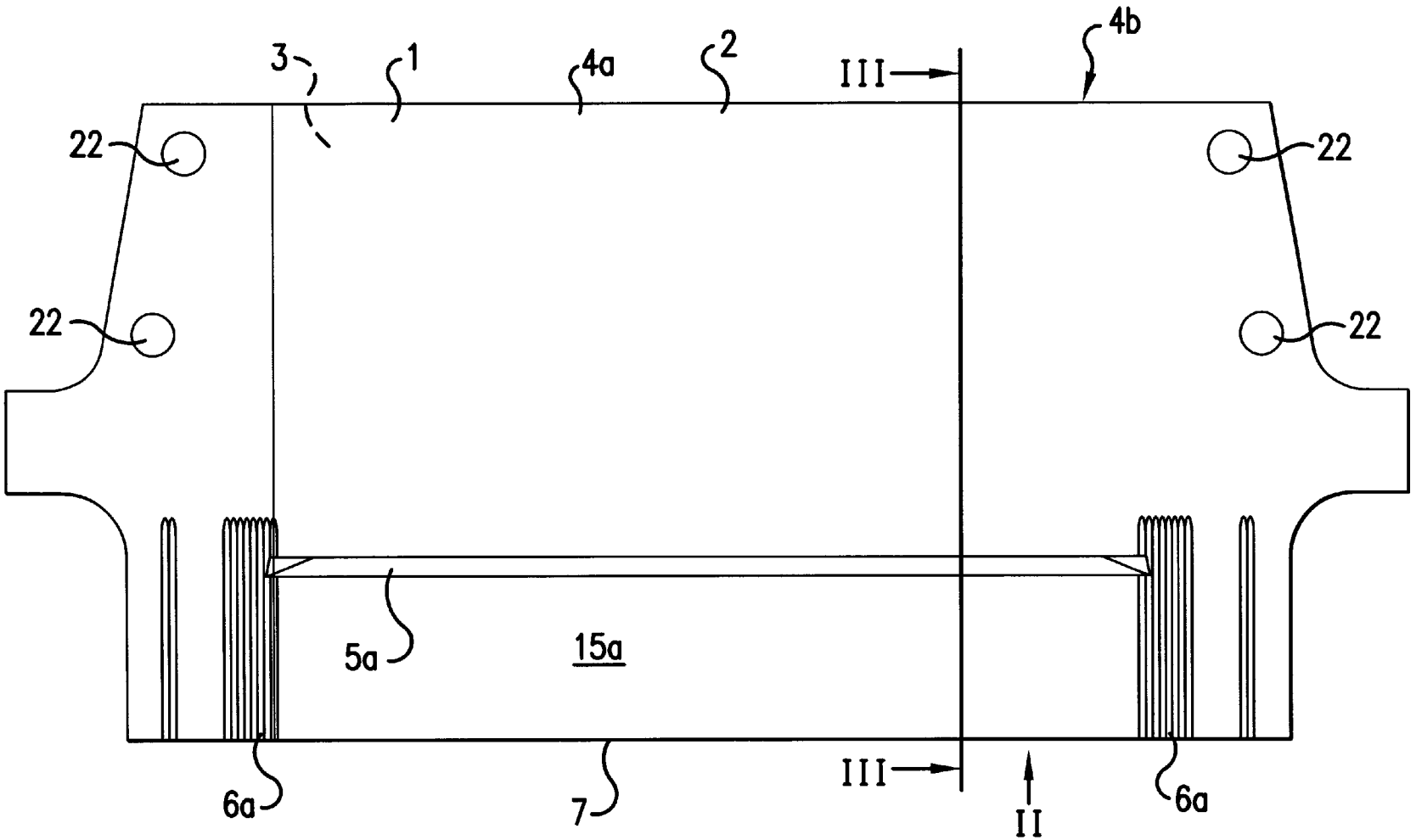
FIG. 1 is a side elevation of a first embodiment of an ink delivery device or "print head attachment" according to the present invention.
Figure 2:
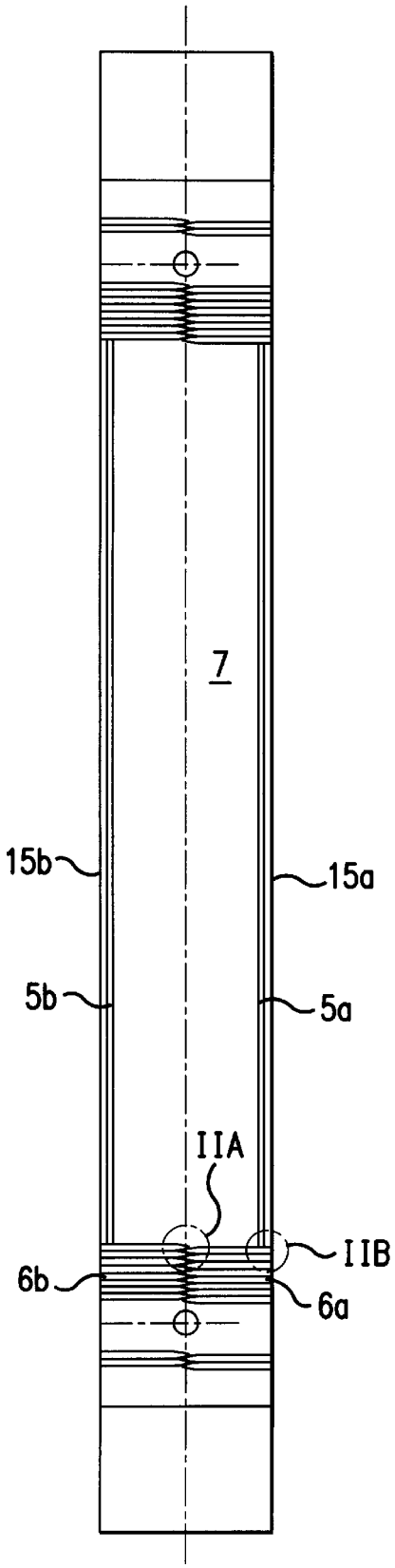
FIG. 2 is a bottom view of the print head attachment shown in FIG. 1.
Figure 2A:
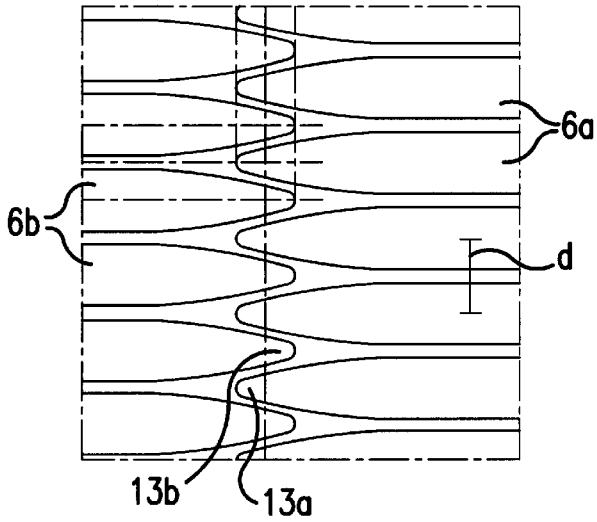
FIG. 2A is a detail of the underside of the print head attachment of FIGS. 1 and 2.
Figure 2B:
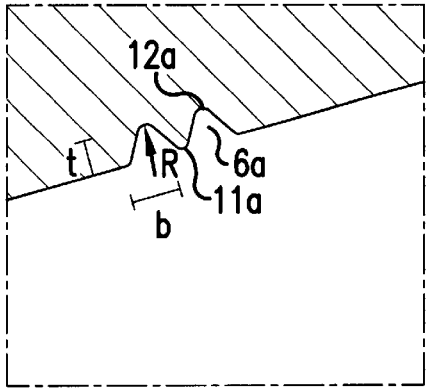
FIG. 2B is a cross-section through a number of ink ducts on the print head attachment shown in FIGS. 1 and 2.

As will be seen from FIG. 2B, the ducts 6*a*, 6*b* are substantially V-shaped in cross-section, with a rounded bottom 12*a*. Between the ducts 6*a* are narrow banks 11*a* which are situated in the surface of the base plate 2. To give an idea of the possible dimensions: the maximum width b of the ducts 6*a* may be 0.28 mm, the maximum depth t 0.2 mm, the center-to-center distance d between the ducts approximately 0.34 mm and the radius R of the bottom 12*a* 0.05 mm.

The ducts 6*b* ARE FORMED in the other side surface 15*b* in the same way, the milling tool being offset by half the center-to-center distance with respect to the base plate 2. As will be seen from FIG. 2A, the ducts 6*a* and 6*b* can extend between one another with their V-shaped or conical end zones 13*a*, 13*b*, so that the duct ends form a relatively dense series of ink delivery ends. A construction of this kind is also very suitable for production by injection moulding techniques.

Figure 4:
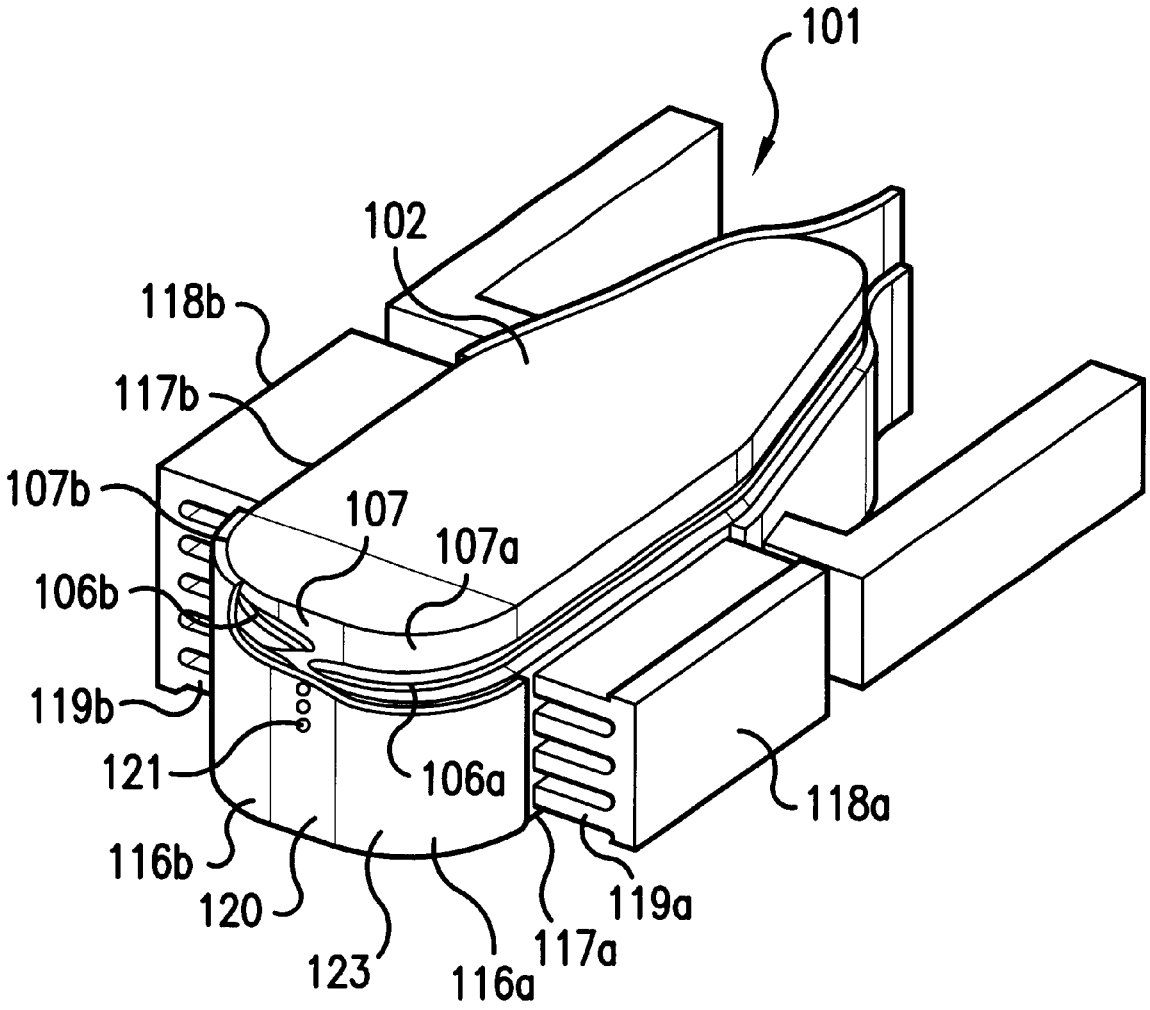
FIG. 4 is a perspective view of a second embodiment of a print head attachment according to the present invention.

FIG. 4 shows a somewhat modified embodiment of the print head attachment 101 according to the invention, in that the ducts are covered from the exterior by a covering layer, for example, a flexible foil 123. At the head surface this foil 123 is provided with continuous holes or nozzles 121 through which the droplets of ink dammed up by the ducts 6*a*, 6*b* and end zones 13*a*, 13*b* can be propelled vertically downwards onto paper or the like. The foil may have a thickness of 0.02 mm or more.

Due to the rounded shape of the surface of the base plate 102 the foil 123 can be bent around it and fixed without forming a permanent deformation, such as a kink. With part 120, the foil 123 can form a zone which forms nozzles 121, and also covers the ducts 106*a*, 106*b* at the head surface with the side surface zones 107*a*, 107*b* being covered by parts 116*a*, 116*b*.

Comb-shaped piezo-electric elements 118*a*, 118*b* are fitted upstream and are provided with legs 119*a*, 119*b* which can be briefly moved downwards by selective actuation. Here the foil 123 is continued by zones 117*a*, 117*b* and extends between the legs 119*a*, 119*b* and the ducts 106*a*, 106*b* in order to cover the ducts and allow the movement of the legs 119*a*, 119*b*, so that the ducts transmit pulsating pressure to the ink present in the ducts and the ink is then ejected through the associated nozzle 121.

The rounded shape of the side surfaces and the head surface is not only advantageous for making the ducts and for the use of a continuous foil, but also for the accuracy of ink delivery, since the ducts have a smooth configuration.

The invention being thus described, it will be obvious that the same may be varied in many ways, such variations are not to be regarded as a departure from the spirit and scope of the invention, and all such modifications as would be obvious to one skilled in the art are intended to be included within the scope of the following claims.

What is claimed is:

1. A device for delivering ink to a receiving material which comprises a body member containing side surface portions which extend into a head surface, said head surface being inclined at an angle relative to the side surface portions forming a head end portion, an ink distribution chamber provided in said body member, a plurality of ink delivery nozzles disposed at the head end portion and a plurality of ink passages extending along one or more of the side surface portions between the ink distribution chamber and the ink delivery nozzles, and ink propulsion means located at said ink passages for selectively propelling ink through said ink passages to the ink delivery nozzles, wherein the ink passages are formed as substantially parallel continuous open ducts in the side surfaces and the adjoining head surfaces of the body member.

2. The device according to claim 1, wherein the ducts follow a smoothly convex curved path in the side surface portions and the adjoining head surface, particularly in the transition zone thereof.

3. The device according to claim 2, wherein the surfaces of the side surface portions and the adjoining head surface are smoothly convexly curved at least in the transition zone thereof.

4. The device according to claim 1, wherein the ducts are covered by a continuous ink-tight layer.

5. The device of claim 4, wherein the ink-tight layer is a foil.

6. The device according to claim 4, wherein the ink delivery nozzles are formed in the ink-tight layer and are situated at the downstream ends of the ducts.

7. The device according to claim 4, wherein the ink propulsion means comprise a plurality of piezo-electric elements operative on the ducts and the ink-tight layer which extends between the piezo-electric elements and the ducts.

8. The device according to claim 1, wherein the body is provided with two opposite sides in which the ducts are formed.

9. The device according to claim 8, wherein the ducts in one side are positionally offset from the ducts in the opposite side.

10. The device according to claim 9, wherein the downstream ends of the ducts are conical.

11. The device according to claim 10, wherein the ink delivery nozzles are all situated along one line.

12. The device according to claim 1, wherein the head surface has a convex surface extending to both sides.

13. An ink jet printer containing a device for delivering ink according to claim 1.

* * * * *